United States Patent [19]

Berczi et al.

[11] Patent Number: 4,524,170

[45] Date of Patent: Jun. 18, 1985

[54] FLAME RETARDANT FINISHING COMPOSITION FOR SYNTHETIC TEXTILES

[75] Inventors: Charles N. Berczi, Ormskirk; Karen Hall, Bury, both of England

[73] Assignee: Milliken Research Corporation, Spartanburg, S.C.

[21] Appl. No.: 531,716

[22] Filed: Sep. 13, 1983

Related U.S. Application Data

[62] Division of Ser. No. 488,346, Apr. 25, 1983, , which is a division of Ser. No. 367,413, Apr. 12, 1982.

[51] Int. Cl.[3] ..... C08K 5/06

[52] U.S. Cl. ..... 524/371; 252/511; 524/405; 524/556; 524/560; 524/566; 260/DIG. 24

[58] Field of Search ..... 252/511; 524/371, 405, 524/436, 511, 560, 566, 556

[56] References Cited

U.S. PATENT DOCUMENTS

| | | | |
|---|---|---|---|
| 3,661,692 | 5/1972 | Berczi | 161/89 |
| 3,708,335 | 1/1973 | Fujiwara et al. | 117/226 |
| 3,877,974 | 4/1975 | Mischutin | 428/290 |
| 3,897,387 | 7/1975 | O'Shaughnessy | 260/45.7 R |
| 3,955,032 | 5/1976 | Mischutin | 428/290 |
| 3,971,202 | 7/1976 | Windley | 57/140 |
| 4,084,622 | 4/1978 | Nakagawa et al. | 139/420 |
| 4,110,296 | 8/1978 | Wang | 524/371 |
| 4,113,902 | 9/1978 | Mischutin | 427/390 D |
| 4,246,359 | 1/1981 | Whelan | 521/92 |
| 4,281,689 | 8/1981 | Benedyk | 139/420 |
| 4,311,636 | 1/1982 | Hahn et al. | 524/371 |
| 4,338,776 | 7/1982 | Krenzer | 57/246 |
| 4,353,997 | 10/1982 | Keogh | 523/210 |
| 4,360,616 | 11/1982 | Pagilagan | 524/100 |

FOREIGN PATENT DOCUMENTS

| | | |
|---|---|---|
| 139607 | 9/1980 | Fed. Rep. of Germany . |
| 655932 | 8/1951 | United Kingdom . |
| 1221877 | 2/1971 | United Kingdom . |
| 1276918 | 6/1972 | United Kingdom . |
| 1428729 | 3/1976 | United Kingdom . |
| 1431568 | 4/1976 | United Kingdom . |
| 1517719 | 12/1978 | United Kingdom . |

OTHER PUBLICATIONS

*Textured Yarn Technology/Production, Properties, and Processing,* Monsanto Co., 1967, Vol. 1, Chapter 8, pp. 179–186.

*Primary Examiner*—Paul R. Michl
*Assistant Examiner*—J. M. Reddick
*Attorney, Agent, or Firm*—H. William Petry; Terry T. Moyer

[57] ABSTRACT

An industrial fabric having a plain woven fabric in which the warp and weft are textured, continuous filament, polyester yarns.

2 Claims, No Drawings

FLAME RETARDANT FINISHING COMPOSITION FOR SYNTHETIC TEXTILES

This is a division of application Ser. No. 488,346, filed Apr. 25, 1983, which in turn is a division of application Ser. No. 367,413, filed Apr. 12, 1982.

This invention relates to industrial fabrics, and more especially to fabrics suitable for use in areas of fire hazard by virtues of their non-flammable and electrically conductive properties.

In mining, and more especially in coal mining, textile fabrics are used for a variety of puposes where the properties mentioned above are desirable. There is a particular need for satisfactory fabrics for use in bags for holding slurries of cementitious material until set. For example, grout bags can be employed to fill the void between a steel supporting arch and the rockface in mine roadways, so as to prevent stress faults from developing. Also, pump bags can be used to support the rock roof exposed as a coalface advances, so as to prevent rockfalls; in this they would replace wood or hydraulic roof supports. Both these techniques are quicker and simpler than the conventional ones they would replace, give better load distribution and can reduce water and gas seepage.

The principal requirements for fabrics for such purposes are that they must have a sufficiently close structure to hold back cementicious aggregates, but open enough to allow surplus water to drain away during filling of the bags. They must be self-extinguishing and without after-glow; and they must have an electrical resistance not exceeding $3\times10^8$ ohms, as described in N.C.B. Specification No. 158/1971 part 4: *Method of Text for Electrical Resistance,* including Amendment No. 3 (March 1973), to avoid build-up of static electricity. In addition, it is desirable that the fabrics should be flexible and stretch sufficiently to accommodate to a rock face, have adequate seam slipping and seam bursting resistance, and that their fire resistance and conductivity properties should be fast to washing, flexing and rubbing, as described in N.C.B. Specification No. 245/1961.

Various fabrics have been tested for such applications, but have proved less than satisfactory. For example, a needle felt has been found difficult to seam and difficult to finish with the necessary fire-resistance and conductivity. Moreover, although it stretches and conforms well to rock surfaces, it is weak and liable to burst, and tears at the stitching. Non-woven fabrics have also been tested, but although they can be made fire-resistant and conductive, they become stiff and conform less well to rock surfaces.

The present invention now provides fabrics and finishes which are more satisfactory for use in grout bags and pump bags and in other situations for which their particular properties make them suitable.

According to a first aspect of the invention, an industrial fabric suitable for the purposes discussed comprises a plain woven fabric composed of textured continuous filament synthetic yarns in both warp and weft. This aspect of the invention also comprehends grout and pump bags made from such fabrics. Polyester yarns are preferred and have the advantage of being cheaper and easier to flame-retard than nylon. In some cases, however, for example where it is desired to provide electrical conductivity by the use of epithropic fibres, nylon may be preferred. Stainless steel filaments may be included in the fabrics to confer conductivity, but they are expensive and decrease the extensibility of the fabric.

The preferred fabrics are woven bulked yarns having counts in the range 110 to 2200 dtex, and may have from 40 to 380 ends and 40 to 380 picks per dm as woven. They are preferably scoured and dried slack to develop their bulk and stretch characteristics, and a finish is then supplied as described below.

In accordance with a second aspect of this invention there is provided a flame-retardant finish, suitable for use on the foregoing fabrics for making grout or pump bags, but equally suitable for other applications where fire-retardant and possibly electrically conductive properties of similar fastness are required.

The finish according to the invention comprises essentially a synergistic combination of a brominated aromatic compound and a metal borate salt, together with a water-resistant polymeric binder, which may itself have fire-retardant properties. Where the finish is required to provide electrical conductivity, it should also contain conductive carbon black.

Preferred formulations for the finish comprise 40–55 parts brominated aromatic compound, 15–30 parts metal borate salt, 10–30 parts water-resistant organic polymeric binder and, if electrical conductivity is also to be conferred by the finish, 0.25–20 parts conductive carbon more usually 0.25 to 3.0 parts, depending on the characteristics of the carbon employed. All these quantitites are given per 100 parts dry solids. The finish may also contain a dispersing agent and, where necessary, a buffer. Where a less conductive carbon is employed, a greater amount must be used, for example more than 10%, in which case a larger amount of flame-retardant must be applied than would otherwise be necessary.

The first component of the fire-retardant system is a brominated aromatic compound. These agents are durable, in contrast to inorganic flame retardant, which are too readily removed by washing. A typical example of a brominated aromatic agent is decabromodiphenyl oxide (DBDO), although others of similar properties may be used.

The second component is a metal borate salt, and more especially a water insoluble borate such as that of zinc or calcium. It has been found that the borate salt has a synergistic effect in combination with the aromatic compound, and provides a highly effective after-glow suppressant. This is in contrast to many other agents, such as antimony trioxide, which gives too much after-glow, and alumina trihydrate, which is difficult to apply.

The binder is an important component, since it renders the finish washable and may itself have flame-retardant properties. It has been discovered that of all the very wide range of possible binders, a self cross-linkable acrylic/vinylidene chloride copolymer gives outstandingly good results. A satisfactory alternative is an acrylic polymer cross-linked with melamine—or urea-formaldehyde, but the copolymer gives a softer handle, which makes bags formed of the finished fabric easier to place in position and gives them a high seam burst strength. After application and drying, the baking conditions required to achieve optimum performance are dictated by the nature of the binder system, but is typically 2–3 minutes exposure at temperature of 150° C.–180° C. If a thickener is used, for example, to enable coarser particles of flame-retardant to be satisfactorily dispersed, it is preferred that a polyacrylic acid or polyacrylate thickener be used with the above binders.

The dispersion is mixed with the other components and is diluted to the required concentration with water, applied, dried and cured by heat.

White fabrics may be preferred for use in mines, because of their greater reflectance and visibility. White fabrics according to the invention can be produced by omitting the conductivity component from the finish and using epithropic fibres in the fabric. Typical epithropic fibres are composed of nylon with the incorporation of conductive carbon, primarily along one side of the fibre. They are currently available in a 20 denier or 22 dtex grade.

The following are specific examples of fabrics and finishes according to the invention, which are described for a better understanding of the preferred practice thereof, but without any intention of limiting the invention thereto.

FABRIC

EXAMPLE 1

A particularly preferred fabric is a plain weave fabric in which both warp and weft consist of $2\times2\times220$ dtex false-twist textured polyester filament yarn with 80 TPM twist. The texturing process is similar to that described in U.S. Pat. No. 4,011,640.

The fabric is woven at 110 ends/dm, 114 picks/dm and has a weight in loom state of 235 g/m$^2$.

After weaving, the fabric is scoured and boiled on a winch or wash range, and dried on a stenter.

EXAMPLE 2

Another example of a fabric according to this invention is a plain weave fabric of 550f 96 dtex polyester ("Terylene" Type 113) air textured by the "TASLAN" process to 605 dtex for both warp and weft.

The fabric is woven with 140 ends/dm and 140 picks/dm and has a loom state weight of 180 g/m$^2$.

FINISH

The following is an example of a preferred finish suitable for application to either of the fabrics of Examples 1 and 2.

EXAMPLE 3

| | | |
|---|---|---|
| DBDO | 45 | parts per 100 parts solid |
| Zinc borate | 27 | parts per 100 parts solid |
| Acrylic/vinylidene chloride copolymer binder | 17.3 | parts per 100 parts solid |
| Conductive carbon | 2.21 | parts per 100 parts solid |
| Dispersing agent | 7.5 | parts per 100 parts solid |
| Buffer | 1.0 | parts per 100 parts solid |

The formulation is dispersed in water and applied to the fabric by padding. The fabric is then dried and baked at a temperature of 160° C. for 150 seconds.

The preferred level of take-up of the finishing materials is about 40% finishing solids by weight on the fabric above in the finished condition (omitting additives). After finishing, the fabrics have the following characteristics:

Example 1—126 ends/dm, 126 picks/dm, 419 g/m$^2$ finished weight

Example 2—153 ends/dm, 153 picks/dm, 298 g/m$^2$ finished weight

We claim:

1. A flame-retardant finishing composition for conferring wash-fast fire-retardant and after-glow suppressant properties on synthetic textiles, comprising from 40 to 55 parts decabromodiphenyl oxide, 15 to 30 parts water-insoluble metal borate salt selected from zinc borate and calcium borate, and 10 to 30 parts water-resistant polymeric binder selected from self cross-linkable acrylic/-vinylidene chloride copolymer and an acrylic polymer cross-linked with melamine or urea formaldehyde per 100 parts of dry solids.

2. A composition according to claim 1 additionally containing 0.25–3.0 parts conductive carbon on the same basis.

* * * * *